US011060043B2

(12) United States Patent
Bhowmik et al.

(10) Patent No.: US 11,060,043 B2
(45) Date of Patent: Jul. 13, 2021

(54) FORMULATION FOR ENHANCING LUBRICITY OF FUELS

(71) Applicant: Hindustan Petroleum Corporation Limited, Bangalore (IN)

(72) Inventors: Sandip Bhowmik, Bangalore (IN); Chintalapati Siva Kesava Raju, Bangalore (IN); Raghava Krishna Kanala, Bangalore (IN); Ganagalla Srinivasa Rao, Bangalore (IN); Ramkumar Mangala, Bangalore (IN); Peddy Venkata Chalapathi Rao, Bangalore (IN); Nettam Venkateswarlu Choudary, Bangalore (IN); Gandham Sriganesh, Bangalore (IN)

(73) Assignee: Hindustan Petroleum Corporation Limited, Bangalore (IN)

( * ) Notice: Subject to any disclaimer, the term of this patent is extended or adjusted under 35 U.S.C. 154(b) by 0 days.

(21) Appl. No.: 16/618,742

(22) PCT Filed: May 4, 2018

(86) PCT No.: PCT/IN2018/050275

§ 371 (c)(1),
(2) Date: Dec. 2, 2019

(87) PCT Pub. No.: WO2018/220640

PCT Pub. Date: Dec. 6, 2018

(65) Prior Publication Data

US 2020/0157449 A1 May 21, 2020

(30) Foreign Application Priority Data

Jun. 2, 2017 (IN) ..... 201741019502

(51) Int. Cl.
*C10L 10/08* (2006.01)
*C10L 1/14* (2006.01)

(52) U.S. Cl.
CPC ..... *C10L 10/08* (2013.01); *C10L 1/14* (2013.01); *C10L 2200/0259* (2013.01); *C10L 2200/0446* (2013.01); *C10L 2270/026* (2013.01)

(58) Field of Classification Search
CPC .... C10L 10/08; C10L 1/14; C10L 2200/0259; C10L 2200/0446; C10L 2270/026; C10L 1/2225; C10L 2290/24; C10L 1/1826; C10L 1/1881
See application file for complete search history.

(56) References Cited

U.S. PATENT DOCUMENTS

| | | | | |
|---|---|---|---|---|
| 4,820,344 | A * | 4/1989 | Geke | G01N 21/91 106/14.13 |
| 6,511,520 | B1 * | 1/2003 | Eber | C10L 1/14 44/388 |
| 8,257,484 | B1 * | 9/2012 | Hawes | C09D 7/20 106/311 |
| 8,518,128 | B2 * | 8/2013 | Reaney | C10L 10/06 44/308 |
| 2004/0237385 | A1 * | 12/2004 | Bongardt | C10L 1/1905 44/386 |
| 2005/0051754 | A1 * | 3/2005 | Maes | C23F 11/10 252/67 |
| 2005/0132641 | A1 * | 6/2005 | McCallum | C10L 10/08 44/385 |
| 2005/0166447 | A1 * | 8/2005 | Corkwell | C10L 1/026 44/415 |
| 2005/0166870 | A1 * | 8/2005 | Wenderoth | F01P 11/06 123/41.01 |
| 2007/0237385 | A1 * | 10/2007 | Kato | G01N 21/9501 382/149 |
| 2007/0241030 | A1 * | 10/2007 | Strom | C10M 175/0016 208/181 |
| 2013/0239468 | A1 * | 9/2013 | Greenfield | C10L 1/2383 44/419 |
| 2016/0369193 | A1 * | 12/2016 | Morris | C10L 1/003 |

FOREIGN PATENT DOCUMENTS

| | | | | |
|---|---|---|---|---|
| JP | H0680995 | A | 3/1994 | |
| WO | WO-01/38463 | A1 | 5/2001 | |
| WO | WO-03020851 | A1 * | 3/2003 | C10L 1/1905 |

OTHER PUBLICATIONS

International Search Report and Written Opinion for Application No. PCT/IN2018/050275, dated Jun. 21, 2018.

* cited by examiner

*Primary Examiner* — Pamela H Weiss
(74) *Attorney, Agent, or Firm* — Marshall, Gerstein & Borun LLP

(57) ABSTRACT

The present disclosure relates to a formulation of diesel additive comprising 2-ethylhexanoic acid, at least one alkylene glycol and at least one alkanolamine which at specific weight ratios, is able to enhance the lubricity of a fuel. Also provided are the methods of preparation and usage of the same. It further relates to the fuel composition comprising the fuel, and the formulation of present disclosure, and the method of preparing the fuel composition.

8 Claims, No Drawings

FORMULATION FOR ENHANCING LUBRICITY OF FUELS

FIELD OF INVENTION

The present disclosure relates to the field of liquid fuels in general, and to an additive formulation for enhancing lubricity of fuels in particular. There is provided an additive formulation comprising 2-ethylhexanoic acid, at least one alkylene glycol and at least one alkanolamine, which when added to fuel leads to enhanced lubricity.

BACKGROUND OF THE INVENTION

Incomplete combustion of components in diesel fuel such as sulphates, and nitrates result in release of particulate matters. These particulate matters add to the levels of pollution and in due course of time, manifest in form of deleterious effects on health. In light of the increasing concern over environmental pollution, regulatory bodies such as Environmental Protection Agency (EPA), USA, started mandating use of low sulphur containing diesel fuel in vehicles.

The ultra-low sulphur diesel (ULSD) fuel, which is in use since 2006, has substantially reduced levels of sulphur, and thus aids in controlling the increasing levels of particulate matter in air. Hydro-treating is the process employed for reducing the levels of sulphur, nitrogen, and aromatics in diesel. However, the treatment also results in expulsion of compounds that provide lubricity to the fuel. Altogether, the reduced sulphur content and absence of lubricating compounds in hydro-treated ULSD fluid deprive the fuel of its lubricity and hence expose engine to constant risk of wear. Lubricity is not an intrinsic property of the fluid and varies with the composition and the material characteristics of the surfaces in relative motion. In order to combat this inevitable and undesired effect of reduced lubricity, ULSD needs to be supplemented with lubricity additive. One of the studies has revealed that use of biodiesel enhances the lubricity in an ULSD fuel (Topaiboul et.al. Songklanakarin J. Sci. Technol. 2010, 32(2): 153-156).

U.S. Pat. No. 5,490,864A discloses a composition of lubricative additive comprising dithiophosphoric diester-dialcohol for use in low sulphur content diesel fuel.

US20050060929A1 reveals a diesel fuel additive composition comprising metallic additives which is stabilised against phase separation.

The lack of lubrication in ULSD fuel increases the friction and in turn heightens the risk of engine failure or breakdown. As mentioned above, there are formulations that are being currently employed as lubricity additives for ULSD. However, most of them suffer from drawbacks such as high cost and inferior performance. Thus, the present scenario necessitates development of lubricity additives that leads to the enhancement in the lubricative property of the ULSD fluid in an effective manner.

SUMMARY OF INVENTION

In an aspect of the present disclosure, there is provided a lubricity additive formulation for enhancing lubricity of a fuel, the formulation comprising: (a) 2-ethylhexanoic acid; (b) at least one alkylene glycol; and (c) at least one alkanolamine.

In an aspect of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine, said process comprising: (a) contacting 2-ethylhexanoic acid, and the at least one alkanolamine to obtain mixture-1; and (b) contacting the mixture-1, and at least one alkylene glycol to obtain the lubricity additive formulation.

In an aspect of the present disclosure, there is provided a method for enhancing lubricity of a fuel, the method comprising, contacting lubricity additive formulation with a fuel to obtain a fuel composition with enhanced lubricity, said lubricity additive formulation comprising: (a) 2-ethylhexanoic acid; (b) at least one alkylene glycol; and (c) at least one alkanolamine.

In an aspect of the present disclosure, there is provided a fuel composition comprising: (a) fuel; and (b) lubricity additive formulation comprising: (i) 2-ethylhexanoic acid; (ii) at least one alkylene glycol; and (iii) at least one alkanolamine.

In an aspect of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition.

These and other features, aspects, and advantages of the present subject matter will be better understood with reference to the following description and appended claims. This summary is provided to introduce a selection of concepts in a simplified form. This summary is not intended to identify key features or essential features of the claimed subject matter, nor is it intended to be used to limit the scope of the claimed subject matter.

DETAILED DESCRIPTION OF THE INVENTION

Those skilled in the art will be aware that the present disclosure is subject to variations and modifications other than those specifically described. It is to be understood that the present disclosure includes all such variations and modifications. The disclosure also includes all such steps, features, compositions, and compounds referred to or indicated in this specification, individually or collectively, and any and all combinations of any or more of such steps or features.

Definitions

For convenience, before further description of the present disclosure, certain terms employed in the specification, and examples are delineated here. These definitions should be read in the light of the remainder of the disclosure and understood as by a person of skill in the art. The terms used herein have the meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The terms "comprise" and "comprising" are used in the inclusive, open sense, meaning that additional elements may be included. It is not intended to be construed as "consists of only".

Throughout this specification, unless the context requires otherwise the word "comprise", and variations such as "comprises" and "comprising", will be understood to imply the inclusion of a stated element or step or group of element or steps but not the exclusion of any other element or step or group of element or steps.

The term "including" is used to mean "including but not limited to". "Including" and "including but not limited to" are used interchangeably.

Lubricity is a measure of a substance's ability to reduce the friction and wear between surfaces which are in relative motion.

Ultra-low-sulphur diesel or ULSD is a diesel fuel with low sulphur content. The sulphur content in ULSD ranges from 5-50 ppm.

Wear scar diameter or WSD is calculated using standard test method, ASTM D 6079, and it measures the extent of wearing the test substance undergoes because of friction. WSD is thus a measure of the fluid lubricity. Lower the WSD value, better is the lubricity. Details of the WSD experiment are mentioned in the experimental section.

Unless defined otherwise, all technical and scientific terms used herein have the same meaning as commonly understood by one of ordinary skill in the art to which this disclosure belongs. Although any methods and materials similar or equivalent to those described herein can be used in the practice or testing of the disclosure, the preferred methods, and materials are now described. All publications mentioned herein are incorporated herein by reference.

Introduction of ultra-low-sulphur diesel fuel or ULSD fuel has significantly brought down the levels of pollution in air. Sulphur, which is not a lubricant in itself, can combine with nickel to form a low melting point alloy and further add to the lubricative property of a diesel fuel. Thus, reduction in levels of sulphur negatively impacts the lubricative property of the fuel. The aforementioned scenario poses a challenge of developing fuels with low sulphur content without compromising on lubricative property. Lubricative additives are added to hydrotreated diesel fuel to compensate for the loss of lubricity. Surface active compounds are usually employed for this purpose as they adhere to the surface of metal oxide and form a protective thin film that reduces friction significantly. Long chain fatty acids are widely known for their lubricative property. Vegetable oils are also being explored for their lubricative property due to the presence of fatty acids and fatty alcohol molecule (Ossia et.al. Journal of mechanical science and technology, 2008, 22: 1527-1536). However, most of the known additives suffer from problems like high cost and low performance with regards to lubricity improvement. The present disclosure reveals a lubricity additive formulation for improving lubricity of diesel, especially ULSD.

The present disclosure is not to be limited in scope by the specific embodiments described herein, which are intended for the purposes of exemplification only. Functionally-equivalent products, compositions, and methods are clearly within the scope of the disclosure, as described herein.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine, wherein 2-ethylhexanoic acid to the at least one alkylene glycol weight ratio is in the range of 1:0.03-1:0.4.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine, wherein 2-ethylhexanoic acid to the at least one alkylene glycol weight ratio is in the range of 1:0.125.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine, wherein 2-ethylhexanoic acid to the at least one alkanolamine weight ratio is in the range of 1:0.06-1:0.4.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine, wherein 2-ethylhexanoic acid to the at least one alkanolamine weight ratio is in the range of 1:0.125.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine, wherein 2-ethylhexanoic acid to the at least one alkylene glycol weight ratio is in the range of 1:0.03-1:0.4, and 2-ethylhexanoic acid to the at least one alkanolamine weight ratio is in the range of 1:0.06-1:0.4.

In an embodiment of the present disclosure, there is provided a lubricity additive formulation for enhancing lubricity of a fuel, the formulation comprising: (a) 2-ethylhexanoic acid; (b) at least one alkylene glycol having 'n' carbon atoms, wherein 'n' is an integer in the range of 2-10; and (c) at least one alkanolamine.

In an embodiment of the present disclosure, there is provided a lubricity additive formulation for enhancing lubricity of a fuel, the formulation comprising: (a) 2-ethylhexanoic acid; (b) at least one alkylene glycol having 'n' carbon atoms, wherein 'n' is an integer in the range of 2-5; and (c) at least one alkanolamine.

In an embodiment of the present disclosure, there is provided a lubricity additive formulation for enhancing lubricity of a fuel, the formulation comprising: (a) 2-ethylhexanoic acid; (b) at least one alkylene glycol having 'n' carbon atoms, wherein 'n' is an integer in the range of 2-10; and (c) at least one alkanolamine, and 2-ethylhexanoic acid to the at least one alkylene glycol weight ratio is in the range of 1:0.03-1:0.4.

In an embodiment of the present disclosure, there is provided a lubricity additive formulation for enhancing lubricity of a fuel, the formulation comprising: (a) 2-ethylhexanoic acid; (b) at least one alkylene glycol having 'n' carbon atoms, wherein 'n' is an integer in the range of 2-10; and (c) at least one alkanolamine, and 2-ethylhexanoic acid to the at least one alkylene glycol weight ratio is 1:0.125.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine, wherein the at least one alkylene glycol is ethylene glycol (n=2).

In an embodiment of the present disclosure, there is provided a lubricity additive formulation for enhancing lubricity of a fuel, the formulation comprising: (a) 2-ethylhexanoic acid; (b) ethylene glycol; and (c) at least one alkanolamine, wherein 2-ethylhexanoic acid to ethylene glycol weight ratio is in the range of 1:0.03-1:0.4.

In an embodiment of the present disclosure, there is provided a lubricity additive formulation for enhancing lubricity of a fuel, the formulation comprising: (a) 2-ethylhexanoic acid; (b) ethylene glycol; and (c) at least one alkanolamine, wherein 2-ethylhexanoic acid to ethylene glycol weight ratio is 1:0.125.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine having 'm' carbon atoms, wherein 'm' is an integer in the range of 1-10.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine having 'm' carbon atoms, wherein 'm' is an integer in the range of 1-5.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine having 'm' carbon atoms, wherein 'm' is an integer in the range of 1-10, and 2-ethylhexanoic acid to the at least one alkanolamine weight ratio is in the range of 1:0.06-1:0.4.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine having 'm' carbon atoms, wherein 'm' is an integer in the range of 1-10, and 2-ethylhexanoic acid to the at least one alkanolamine weight ratio is 1:0.125.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine, wherein the at least one alkanolamine is monoethanolamine (m=2).

In an embodiment of the present disclosure, there is provided a lubricity additive formulation for enhancing lubricity of a fuel, the formulation comprising: (a) 2-ethylhexanoic acid; (b) at least one alkylene glycol; and (c) monoethanolamine, wherein 2-ethylhexanoic acid to monoethanolamine weight ratio is in the range of 1:0.06-1:0.4.

In an embodiment of the present disclosure, there is provided a lubricity additive formulation for enhancing lubricity of a fuel, the formulation comprising: (a) 2-ethylhexanoic acid; (b) at least one alkylene glycol; and (c) monoethanolamine, wherein 2-ethylhexanoic acid to monoethanolamine weight ratio is 1:0.125.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine, wherein the fuel is a diesel having sulphur content in the range of 5 ppm to 50 ppm.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine, wherein the fuel is a diesel with having sulphur content in the range of 5 ppm to 25 ppm.

In an embodiment of the present disclosure, there is provided a lubricity additive formulation for enhancing lubricity of a fuel, the formulation comprising: (a) 2-ethylhexanoic acid; (b) at least one alkylene glycol; and (c) at least one alkanolamine, wherein the fuel is a diesel with having sulphur content in the range of 5 ppm to 10 ppm.

In an embodiment of the present disclosure, there is provided a lubricity additive formulation for enhancing lubricity of a fuel, the formulation comprising: (a) 2-ethylhexanoic acid; (b) ethylene glycol; and (c) monoethanolamine, wherein 2-ethylhexanoic acid to ethylene glycol weight ratio is in the range of 1:0.03-1:0.4, and 2-ethylhexanoic acid to monoethanolamine weight ratio is in the range of 1:0.06-1:0.4.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) at least one alkylene glycol having weight percentage in the range of 3-20% with respect to the formulation; and (c) at least one alkanolamine having weight percentage in the range of 5-20% with respect to the formulation.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) at least one alkylene glycol having weight percentage in the range of 3-20% with respect to the formulation; and (c) at least one alkanolamine having weight percentage in the range of 5-20% with respect to the formulation, wherein 2-ethylhexanoic acid to the at least one alkylene glycol weight ratio is in the range of 1:0.03-1:0.4.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) at least one alkylene glycol having weight percentage in the range of 3-20% with respect to the formulation, wherein the at least one alkylene glycol has 'n' carbon atoms, and 'n' is an integer in the range of 2-10; and (c) at least one alkanolamine having weight percentage in the range of 5-20% with respect to the formulation, wherein 2-ethylhexanoic acid to the at least one alkylene glycol weight ratio is in the range of 1:0.03-1:0.4.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) at least one alkylene glycol having weight percentage in the range of 3-20% with respect to the formulation; and (c) at least one alkanolamine having weight percentage in the range of 5-20% with respect to the formulation, wherein 2-ethylhexanoic acid to the at least one alkylene glycol weight ratio is 1:0.125.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) at least one alkylene glycol having weight percentage in the range of 3-20% with respect to the formulation, wherein the at least one alkylene glycol has 'n' carbon atoms, and 'n' is an integer in the range of 2-10; and (c) at least one alkanolamine having weight percentage in the range of 5-20% with respect to the formulation, wherein 2-ethylhexanoic acid to the at least one alkylene glycol weight ratio is 1:0.125.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) ethylene glycol having weight percentage in the range of 3-20% with respect to the formulation; and (c) at least one alkanolamine having weight percentage in the range of 5-20% with respect to the formulation, wherein 2-ethylhexanoic acid to ethylene glycol weight ratio is in the range of 1:0.03-1:0.4.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) at least one alkylene glycol having weight percentage in the range of 3-20% with respect to the formulation; and (c) at least one alkanolamine having weight percentage in the range of 5-20% with respect to the formulation, wherein 2-ethylhexanoic acid to the at least one alkanolamine weight ratio is in the range of 1:0.06-1:0.4.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) at least one alkylene glycol having weight percentage in the range of 3-20% with respect to the formulation; and (c) at least one alkanolamine having weight percentage in the range of 5-20% with respect to the formulation, wherein the at least one alkanolamine has 'm' carbon atoms, and 'm' is an integer in the range of 1-10, and 2-ethylhexanoic acid to the at least one alkanolamine weight ratio is in the range of 1:0.06-1:0.4.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) at least one alkylene glycol having weight percentage in the range of 3-20% with respect to the formulation; and (c) at least one alkanolamine having weight percentage in the range of 5-20% with respect to the formulation, wherein 2-ethylhexanoic acid to the at least one alkanolamine weight ratio is 1:0.125.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) at least one alkylene glycol having weight percentage in the range of 3-20% with respect to the formulation; and (c) at least one alkanolamine having weight percentage in the range of 5-20% with respect to the formulation, wherein the at least one alkanolamine has 'm' carbon atoms, and 'm' is an integer in the range of 2-10, and 2-ethylhexanoic acid to the at least one alkanolamine weight ratio is 1:0.125.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) at least one alkylene glycol having weight percentage in the range of 3-20% with respect to the formulation; and (c) monoethanolamine having weight percentage in the range of 5-20% with respect to the formulation, wherein 2-ethylhexanoic acid to monoethanolamine weight ratio is in the range of 1:0.06-1:0.4.

In an embodiment of the present disclosure, there is provided a lubricity additive formulation for enhancing lubricity of a fuel, the formulation comprising: (a) 2-ethylhexanoic acid having weight percentage of 80% with respect to the formulation; (b) at least one alkylene glycol having weight percentage of 10% with respect to the formulation; and (c) at least one alkanolamine having weight percentage of 10% with respect to the formulation, wherein 2-ethylhexanoic acid to the at least one alkylene glycol weight ratio is 1:0.125.

In an embodiment of the present disclosure, there is provided a lubricity additive formulation for enhancing lubricity of a fuel, the formulation comprising: (a) 2-ethylhexanoic acid having weight percentage in the range of 50-90% with respect to the formulation; (b) ethylene glycol having weight percentage in the range of 3-20% with respect to the formulation; and (c) monoethanolamine having weight percentage in the range of 5-20% with respect to the formulation, wherein 2-ethylhexanoic to ethylene glycol weight ratio is in the range of 1:0.03-1:0.4, and 2-ethylhexanoic acid to monoethanolamine weight ratio is in the range of 1:0.06-1:0.4.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine, said process comprising: (a) contacting 2-ethylhexanoic acid, and the at least one alkanolamine to obtain mixture-1; and (b) contacting the mixture-1, and the at least one alkylene glycol to obtain the lubricity additive formulation.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine, said process comprising: (a) contacting 2-ethylhexanoic acid, and the at least one alkanolamine to obtain mixture-1; and (b) contacting the mixture-1, and the at least one alkylene glycol to obtain the lubricity additive formulation, wherein 2-ethylhexanoic acid to the at least one alkylene glycol weight ratio is in the range of 1:0.03-1:0.4.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol having 'n' carbon atoms, wherein 'n' is an integer in the range of 2-10; and (iii) at least one alkanolamine, said process comprising: (a) contacting 2-ethylhexanoic acid, and the at least one alkanolamine to obtain mixture-1; and (b) contacting the mixture-1, and the at least one alkylene glycol to obtain the lubricity additive formulation.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol having 'n' carbon atoms, wherein 'n' is an integer in the range of 2-10; and (iii) at least one alkanolamine, said process comprising: (a) contacting 2-ethylhexanoic acid, and the at least one alkanolamine to obtain mixture-1; and (b) contacting the mixture-1, and the at least one alkylene glycol to obtain the lubricity additive formulation, wherein 2-ethylhexanoic acid to the at least one alkylene glycol weight ratio is in the range of 1:0.03-1:0.4.

In an embodiment of the present disclosure, there is provided a process for preparation of lubricity additive formulation for enhancing lubricity of a fuel, the formulation comprising: (i) 2-ethylhexanoic acid; (ii) ethylene glycol; and (iii) at least one alkanolamine, said process comprising: (a) contacting 2-ethylhexanoic acid, and the at least one alkanolamine to obtain mixture-1; and (b) contacting the mixture-1, and ethylene glycol to obtain the lubricity additive formulation, wherein 2-ethylhexanoic acid to ethylene glycol weight ratio is in the range of 1:0.03-1:0.4.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine, said process comprising: (a) contacting 2-ethylhexanoic acid, and the at least one alkanolamine to obtain mixture-1; and (b) contacting the mixture-1, and the at least one alkylene glycol to obtain the lubricity additive formulation, wherein 2-ethylhexanoic acid to the at least one alkanolamine weight ratio is in the range of 1:0.06-1:0.4.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine having 'm' carbon atoms, wherein 'm' is an integer in the range of 1-10, said process comprising: (a) contacting 2-ethylhexanoic acid, and the at least one alkanolamine to obtain mixture-1; and (b) contacting the mixture-1, and the at least one alkylene glycol to obtain the lubricity additive formulation.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine having 'm' carbon atoms, wherein 'm' is an integer in the range of 1-10, said process comprising: (a) contacting 2-ethylhexanoic acid, and the at least one alkanolamine to obtain mixture-1; and (b) contacting the mixture-1, and the at least one alkylene glycol to obtain the lubricity additive formulation, wherein 2-ethylhexanoic acid to the at least one alkanolamine weight ratio is in the range of 1:0.06-1:0.4.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) monoethanolamine, said process comprising: (a) contacting 2-ethylhexanoic acid, and monoethanolamine to obtain mixture-1; and (b) contacting the mixture-1, and the at least one alkylene glycol to obtain the lubricity additive formulation, wherein 2-ethylhexanoic acid to monoethanolamine weight ratio is in the range of 1:0.06-1:0.4.

In an embodiment of the present disclosure, there is provided a process for preparation of lubricity additive formulation for enhancing lubricity of a fuel, the formulation comprising: (i) 2-ethylhexanoic acid having weight percentage in the range of 50-90% with respect to the formulation; (ii) at least one alkylene glycol having weight percentage in the range of 3-20% with respect to the formulation; and (iii) at least one alkanolamine having weight percentage is in the range of 5-20% with respect to the formulation, said process comprising: (a) contacting 2-ethylhexanoic acid, and the at least one alkanolamine to obtain mixture-1; and (b) contacting the mixture-1, and the at least one alkylene glycol to obtain the lubricity additive formulation.

In an embodiment of the present disclosure, there is provided a process for preparation of lubricity additive formulation for enhancing lubricity of a fuel, the formulation comprising: (i) 2-ethylhexanoic acid; (ii) ethylene glycol; and (iii) monoethanolamine, said process comprising: (a) contacting 2-ethylhexanoic acid, and monoethanolamine to obtain mixture-1; and (b) contacting the mixture-1, and ethylene glycol to obtain the lubricity additive formulation, wherein 2-ethylhexanoic to ethylene glycol weight ratio is in the range of 1:0.03-1:0.4, and 2-ethylhexanoic acid to monoethanolamine weight ratio is in the range of 1:0.06-1:0.4.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine, said process comprising: (a) contacting 2-ethylhexanoic acid, and the at least one alkanolamine to obtain mixture-1 is carried out at a temperature in the range of 25-35° C. for a period in the range of 5-15 minutes at a stirring speed in the range of 200-500 rpm; and (b) contacting the mixture-1, and the at least one alkylene glycol to obtain the lubricity additive formulation is carried out at a temperature in the range of 25-35° C. for a period in the range of 50-80 minutes at a stirring speed in the range of 200-500 rpm.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine, said process comprising: (a) contacting 2-ethylhexanoic acid, and the at least one alkanolamine to obtain mixture-1 is carried out at a temperature in the range of 25-35° C. for a period of 10 minutes at a stirring speed in the range of 200-500 rpm; and (b) contacting the mixture-1, and the at least one alkylene glycol to obtain the lubricity additive formulation is carried out at a temperature in the range of 25-35° C. for a period of 60 minutes at a stirring speed in the range of 200-500 rpm.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine, said process comprising: (a) contacting 2-ethylhexanoic acid, and the at least one alkanolamine to obtain mixture-1 is carried out at a temperature in the range of 25-35° C. for a period in the range of 5-15 minutes at a stirring speed in the range of 200-500 rpm; and (b) contacting the mixture-1, and the at least one alkylene glycol to obtain the lubricity additive formulation is carried out at a temperature in the range of 25-35° C. for a period in the range of 50-80 minutes at a stirring speed in the range of 200-500 rpm, wherein 2-ethylhexanoic acid to the at least one alkylene glycol weight ratio is in the range of 1:0.03-1:0.4.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol having 'n' carbon atoms, and 'n' is an integer in the range of 2-10; and (iii) at least one alkanolamine, said process comprising: (a) contacting 2-ethylhexanoic acid, and the at least one alkanolamine to obtain mixture-1 is carried out at a temperature in the range of 25-35° C. for a period in the range of 5-15 minutes at a stirring speed in the range of 200-500 rpm; and (b) contacting the mixture-1, and the at least one alkylene glycol to obtain the lubricity additive formulation is carried out at a temperature in the range of 25-35° C. for a period in the range of 50-80 minutes at a stirring speed in the range of 200-500 rpm.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine, said process comprising: (a) contacting 2-ethylhexanoic acid, and the at least one alkanolamine to obtain mixture-1 is carried out at a temperature in the range of 25-35° C. for a period in the range of 5-15 minutes at a stirring speed in the range of 200-500 rpm; and (b) contacting the mixture-1, and the at least one alkylene glycol to obtain the lubricity additive formulation is carried out at a temperature in the range of 25-35° C. for a period in the range of 50-80 minutes at a stirring speed in the range of 200-500 rpm, wherein 2-ethylhexanoic acid to the at least one alkylene glycol weight ratio is 1:0.125.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine, said process comprising: (a) contacting 2-ethylhexanoic acid, and the at least one alkanolamine to obtain mixture-1 is carried out at a temperature in the range of 25-35° C. for a period in the range of 5-15 minutes at a stirring speed in the range of 200-500 rpm; and (b) contacting the mixture-1, and the at least one alkylene glycol to obtain the lubricity additive formulation is carried out at a temperature in the range of 25-35° C. for a period in the range of 50-80 minutes at a stirring speed in the range of 200-500 rpm, wherein 2-ethylhexanoic acid to the at least one alkanolamine weight ratio is in the range of 1:0.06-1:0.4.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine having 'm' carbon atoms, and 'm' is an integer in the range of 1-10, said process comprising: (a) contacting 2-ethylhexanoic acid, and the at least one alkanolamine to obtain mixture-1 is carried out at a temperature in the range of 25-35° C. for a period in the range of 5-15 minutes at a stirring speed in the range of 200-500 rpm; and (b) contacting the mixture-1, and the at least one alkylene glycol to obtain the lubricity additive formulation is carried out at a temperature in the range of 25-35° C. for a period in the range of 50-80 minutes at a stirring speed in the range of 200-500 rpm.

In an embodiment of the present disclosure, there is provided a process for preparation of lubricity additive formulation for enhancing lubricity of a fuel, the formulation comprising: (i) 2-ethylhexanoic acid; (ii) at least one alkylene glycol; and (iii) at least one alkanolamine, said process comprising: (a) contacting 2-ethylhexanoic acid, and the at least one alkanolamine to obtain mixture-1 is carried out at a temperature in the range of 25-35° C. for a period in the range of 5-15 minutes at a stirring speed in the range of 200-500 rpm; and (b) contacting the mixture-1, and the at least one alkylene glycol to obtain the lubricity additive formulation is carried out at a temperature in the range of 25-35° C. for a period in the range of 50-80 minutes at a stirring speed in the range of 200-500 rpm, wherein 2-ethylhexanoic acid to the at least one alkanolamine weight ratio is 1:0.125.

In an embodiment of the present disclosure, there is provided a process for preparation of lubricity additive formulation for enhancing lubricity of a fuel, the formulation comprising: (i) 2-ethylhexanoic acid having weight percentage in the range of 50-90% with respect to the formulation; (ii) at least one alkylene glycol having weight percentage in the range of 3-20% with respect to the formulation; and (iii) at least one alkanolamine having weight percentage in the range of 5-20% with respect to the formulation, said process comprising: (a) contacting 2-ethylhexanoic acid, and the at least one alkanolamine to obtain mixture-1 is carried out at a temperature in the range of 25-35° C. for a period in the range of 5-15 minutes at a stirring speed in the range of 200-500 rpm; and (b) contacting the mixture-1, and the at least one alkylene glycol to obtain the lubricity additive formulation is carried out at a temperature in the range of 25-35° C. for a period in the range of 50-80 minutes at a stirring speed in the range of 200-500 rpm.

In an embodiment of the present disclosure, there is provided a process for preparation of lubricity additive formulation for enhancing lubricity of a fuel, the formulation comprising: (i) 2-ethylhexanoic acid; (ii) ethylene glycol; and (iii) monoethanolamine, said process comprising: (a) contacting 2-ethylhexanoic acid, and monoethanolamine to obtain mixture-1 is carried out at a temperature in the range of 25-35° C. for a period in the range of 5-15 minutes at a stirring speed in the range of 200-500 rpm; and (b) contacting the mixture-1, and ethylene glycol to obtain the lubricity additive formulation is carried out at a temperature in the range of 25-35° C. for a period in the range of 50-80 minutes at a stirring speed in the range of 200-500 rpm, wherein 2-ethylhexanoic to ethylene glycol weight ratio is in the range of 1:0.03-1:0.4, and 2-ethylhexanoic acid to monoethanolamine weight ratio is in the range of 1:0.06-1:0.4.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity, wherein 2-ethylhexanoic acid to the at least one alkylene glycol weight ratio is in the range of 1:0.03-1:0.4.

In an embodiment of the present disclosure, there is provided a method for enhancing lubricity of a fuel, the method comprising, contacting lubricity additive formulation comprising: (a) 2-ethylhexanoic acid; (b) at least one alkylene glycol having 'n' carbon atoms, wherein 'n' is an integer in the range of 2-10; and (c) at least one alkanolamine, with a fuel to obtain a fuel composition with enhanced lubricity.

In an embodiment of the present disclosure, there is provided a method for enhancing lubricity of a fuel, the method comprising, contacting lubricity additive formulation comprising: (a) 2-ethylhexanoic acid; (b) ethylene glycol; and (c) at least one alkanolamine, with a fuel to obtain a fuel composition with enhanced lubricity.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity, wherein 2-ethylhexanoic acid to the at least one alkanolamine weight ratio is in the range of 1:0.06-1:0.4

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine having 'm' carbon atoms, wherein 'm' is an integer in the range of 1-10, with a fuel to obtain a fuel composition with enhanced lubricity.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) monoethanolamine, with a fuel to obtain a fuel composition with enhanced lubricity.

In an embodiment of the present disclosure, there is provided a method for enhancing lubricity of a fuel, the method comprising, contacting lubricity additive formulation comprising: (a) 2-ethylhexanoic acid; (b) ethylene glycol; and (c) monoethanolamine, with a fuel to obtain a fuel composition with enhanced lubricity, wherein 2-ethylhexanoic to ethylene glycol weight ratio is in the range of 1:0.03-1:0.4, and 2-ethylhexanoic acid to monoethanolamine weight ratio is in the range of 1:0.06-1:0.4.

In an embodiment of the present disclosure, there is provided a method for enhancing lubricity of a fuel, the method comprising, contacting lubricity additive formulation comprising: (a) 2-ethylhexanoic acid having weight percentage in the range of 50-90%; (b) at least one alkylene glycol having weight percentage in the range of 3-20%; and (c) at least one alkanolamine having weight percentage in the range of 5-20%, with a fuel to obtain a fuel composition with enhanced lubricity.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity, wherein the lubricity additive formulation has concentration in the range of 20-120 ppm in the fuel composition.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity, wherein the lubricity additive formulation has concentration in the range of 50-90 ppm in the fuel composition.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity, wherein the lubricity additive formulation has concentration of 50 ppm in the fuel composition.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity, wherein the lubricity additive formulation has concentration of 75 ppm in the fuel composition.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity, wherein the lubricity additive formulation has concentration of 90 ppm in the fuel composition.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity, wherein the fuel is a diesel having sulphur content in the range of 5-50 ppm.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity, wherein the fuel is a diesel having sulphur content in the range of 5-10 ppm.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity, wherein the fuel is a diesel having sulphur content in the range of 5-50 ppm, and the lubricity additive formulation has concentration in the range of 20-120 ppm in the fuel composition.

In an embodiment of the present disclosure, there is provided a method for enhancing lubricity of a fuel, the method comprising, contacting lubricity additive formulation comprising: (a) 2-ethylhexanoic acid; (b) at least one alkylene glycol; and (c) at least one alkanolamine, with a fuel to obtain a fuel composition with enhanced lubricity, wherein the fuel is a diesel having sulphur content in the range of 5-10 ppm, and the lubricity additive formulation has concentration in the range of 50-90 ppm in the fuel composition.

In an embodiment of the present disclosure, there is provided a fuel composition comprising: (a) fuel; and (b) lubricity additive formulation comprising: (i) 2-ethylhexanoic acid; (ii) at least one alkylene glycol; and (iii) at least one alkanolamine.

In an embodiment of the present disclosure, there is provided a fuel composition comprising: (a) fuel; and (b) lubricity additive formulation comprising: (i) 2-ethylhexanoic acid; (ii) at least one alkylene glycol; and (iii) at least one alkanolamine, wherein 2-ethylhexanoic acid to the at least one alkylene glycol weight ratio is in the range of 1:0.03-1:0.4.

In an embodiment of the present disclosure, there is provided a fuel composition comprising: (a) fuel; and (b) lubricity additive formulation comprising: (i) 2-ethylhexanoic acid; (ii) at least one alkylene glycol having 'n' carbon atoms, wherein 'n' is an integer in the range of 2-10; and (iii) at least one alkanolamine.

In an embodiment of the present disclosure, there is provided a fuel composition comprising: (a) fuel; and (b) lubricity additive formulation comprising: (i) 2-ethylhexanoic acid; (ii) ethylene glycol; and (iii) at least one alkanolamine.

In an embodiment of the present disclosure, there is provided a fuel composition comprising: (a) fuel; and (b) lubricity additive formulation comprising: (i) 2-ethylhexanoic acid; (ii) at least one alkylene glycol; and (iii) at least one alkanolamine, wherein 2-ethylhexanoic acid to the at least one alkanolamine weight ratio is in the range of 1:0.06-1:0.4.

In an embodiment of the present disclosure, there is provided a fuel composition comprising: (a) fuel; and (b) lubricity additive formulation comprising: (i) 2-ethylhexanoic acid; (ii) at least one alkylene glycol; and (iii) at least one alkanolamine having 'm' carbon atoms, wherein 'm' is an integer in the range of 1-10.

In an embodiment of the present disclosure, there is provided a fuel composition comprising: (a) fuel; and (b) lubricity additive formulation comprising: (i) 2-ethylhexanoic acid; (ii) at least one alkylene glycol; and (iii) monoethanolamine.

In an embodiment of the present disclosure, there is provided a fuel composition comprising: (a) fuel; and (b) lubricity additive formulation comprising: (i) 2-ethylhexanoic acid; (ii) ethylene glycol; and (iii) monoethanolamine, wherein 2-ethylhexanoic to ethylene glycol weight ratio is in the range of 1:0.03-1:0.4, and 2-ethylhexanoic acid to monoethanolamine weight ratio is in the range of 1:0.06-1:0.4.

In an embodiment of the present disclosure, there is provided a fuel composition comprising: (a) fuel; and (b) lubricity additive formulation comprising: (i) 2-ethylhexanoic acid having weight percentage in the range of 50-90%; (ii) at least one alkylene glycol having weight percentage in the range of 3-20%; and (iii) at least one alkanolamine having weight percentage in the range of 5-20%.

In an embodiment of the present disclosure, there is provided a fuel composition comprising: (a) fuel; and (b) lubricity additive formulation comprising: (i) 2-ethylhexanoic acid; (ii) at least one alkylene glycol; and (iii) at least one alkanolamine, wherein the lubricity additive formulation has concentration in the range of 20-120 ppm in the fuel.

In an embodiment of the present disclosure, there is provided a fuel composition comprising: (a) fuel; and (b) lubricity additive formulation comprising: (i) 2-ethylhexanoic acid; (ii) at least one alkylene glycol; and (iii) at least one alkanolamine, wherein the fuel is a diesel having sulphur content in the range of 5-50 ppm.

In an embodiment of the present disclosure, there is provided a fuel composition comprising: (a) fuel; and (b) lubricity additive formulation comprising: (i) 2-ethylhexanoic acid; (ii) at least one alkylene glycol; and (iii) at least one alkanolamine, wherein the fuel is a diesel having sulphur content in the range of 5-10 ppm.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein 2-ethylhexanoic acid to the at least one alkylene glycol weight ratio is in the range of 1:0.03-1:0.4.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol having 'n' carbon atoms, wherein 'n' is an integer in the range of 2-10; and (iii) at least one alkanolamine; (b) obtaining a fuel; and (c) contacting the lubricity additive formulation and the fuel to obtain the fuel composition.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein 2-ethylhexanoic acid to the at least one alkylene glycol weight ratio is 1:0.125.

In an embodiment of the present disclosure, there is provided a method for preparation of a fuel composition, the method comprising steps of: (a) obtaining lubricity additive formulation comprising: (i) 2-ethylhexanoic acid; (ii) ethylene glycol; and (iii) at least one alkanolamine; (b) obtaining a fuel; and (c) contacting the lubricity additive formulation and the fuel to obtain the fuel composition.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein 2-ethylhexanoic acid to the at least one alkanolamine weight ratio is in the range of 1:0.06-1:0.4.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine having 'm' carbon atoms, wherein 'm' is an integer in the range of 1-10; (b) obtaining a fuel; and (c) contacting the lubricity additive formulation and the fuel to obtain the fuel composition.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein 2-ethylhexanoic acid to the at least one alkanolamine weight ratio is 1:0.125.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) monoethanolamine; (b) obtaining a fuel; and (c) contacting the lubricity additive formulation and the fuel to obtain the fuel composition.

In an embodiment of the present disclosure, there is provided a method for preparation of a fuel composition, the method comprising steps of: (a) obtaining lubricity additive formulation comprising: (i) 2-ethylhexanoic acid; (ii) ethylene glycol; and (iii) methanolamine; (b) obtaining a fuel; and (c) contacting the lubricity additive formulation and the fuel to obtain the fuel composition, wherein 2-ethylhexanoic to ethylene glycol weight ratio is in the range of 1:0.03-1:0.4, and 2-ethylhexanoic acid to monoethanolamine weight ratio is in the range of 1:0.06-1:0.4.

In an embodiment of the present disclosure, there is provided a method for preparation of a fuel composition, the method comprising steps of: (a) obtaining lubricity additive formulation comprising: (i) 2-ethylhexanoic acid having weight percentage in the range of 50-90%; (ii) at least one alkylene glycol having weight percentage in the range of 3-20%; and (iii) at least one alkanolamine having weight percentage in the range of 5-20%; (b) obtaining a fuel; and (c) contacting the lubricity additive formulation and the fuel to obtain the fuel composition.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein the lubricity additive formulation has concentration in the range of 20-120 ppm.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein the lubricity additive formulation has concentration in the range of 50-90 ppm.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein the lubricity additive formulation has concentration of 75 ppm.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein the fuel is a diesel having sulphur content in the range of 5-50 ppm.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein the fuel is a diesel having sulphur content in the range of 5-10 ppm.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein the fuel is a diesel having sulphur content in the range of 5-50 ppm, and the lubricity additive formulation has concentration in the range of 20-120 ppm in the fuel composition.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein the fuel is a diesel having sulphur content in the range of 5-10 ppm, and the lubricity additive formulation has concentration in the range of 50-90 ppm in the fuel composition.

In an embodiment of the present disclosure, there is provided a method for preparation of a fuel composition, the method comprising steps of: (a) obtaining lubricity additive formulation comprising: (i) 2-ethylhexanoic acid; (ii) at least one alkylene glycol; and (iii) at least one alkanolamine; (b) obtaining a fuel; and (c) contacting the lubricity additive formulation and the fuel to obtain the fuel composition, wherein the fuel is a diesel having sulphur content of 10 ppm, and the lubricity additive formulation has concentration of 75 ppm in the fuel composition.

In an embodiment of the present disclosure, there is provided a lubricity additive formulation herein, wherein the formulation can be used for enhancing lubricity of a low-sulphur-diesel (LSD) fuel.

In an embodiment of the present disclosure, there is provided a lubricity additive formulation herein, wherein the formulation can be used for enhancing lubricity of ultra-low-sulphur diesel (ULSD) fuel.

EXAMPLES

The disclosure will now be illustrated with working examples, which is intended to illustrate the working of disclosure and not intended to take restrictively to imply any limitations on the scope of the present disclosure. Unless defined otherwise, all technical and scientific terms used herein have the same meaning as commonly understood to one of ordinary skill in the art to which this disclosure belongs. Although methods and materials similar or equivalent to those described herein can be used in the practice of the disclosed methods and compositions, the exemplary methods, devices and materials are described herein. It is to be understood that this disclosure is not limited to particular methods, and experimental conditions described, as such methods and conditions may vary.

Example 1

Preparation of the DLA (Diesel Lubricity Additives):

A mixture of 80 ml of triethylamine and 50 ml of monoethanolamine (alkanolamine) was prepared and added dropwise to 200 ml of 2-ethyl hexanoic acid, placed in a round bottom flask, to obtain mixture-1. The addition was performed at room temperature over a period of 10 minutes at a constant stirring speed of 200-500 rpm. To the above resulting viscous mixture-1, 50 ml of ethylene glycol (alkylene glycol) was added. The addition was performed at room temperature over a period of 60 minutes at a constant stirring speed of 200-500 rpm. The final product obtained was a yellow viscous liquid which would subsequently be used as diesel lubricity additive (DLA) in fuel.

Preparation of the Diesel Fuel:

Diesel fuel with low sulphur content—Ultra-low-sulphur diesel (ULSD) fuel was used for the study. The sulphur content in the aforementioned fuel is in the range of 5-10 ppm and was obtained from the refinery through diesel hydrodesulphurization and diesel hydrotreating methods.

Preparation of Different Fuel Compositions with Varying Amounts of DLA and Sulphur Content:

Various fuel compositions were prepared by adding different amounts, of diesel lubricity additive (DLA), ranging from 20-120 ppm. Simultaneously, the amount of sulphur was also varied from 5-10 ppm and the formulations were exposed to high frequency reciprocating rig (HFRR) test. The fuel compositions tested are mentioned in Table 1.

Determination of Wear Scar Diameter (WSD):

HFRR is the most commonly employed test for evaluation of diesel fuels. Friction coefficient and protective film percentage was monitored throughout the experiment. Wear scar diameter (WSD) was measured by ASTM (American Society for Testing and Materials) 6079 method. In brief, a stainless steel ball was vibrated against a flat steel surface at 200 g load, 50 Hz frequency, at a temperature of 60° C. and at 1 mm amplitude for 75 minutes, in the presence of the fuel composition to be tested. The ball was removed and observed under microscope for the formation of wear scar. The average of width and the length of the scar was reported as wear scar diameter in Table 1. According to the IS 1460 specification, 0.46 mm or 460 μM is maximum permissible WSD value, and diesel fuel is considered to have sufficient lubricity under this value.

Results:

TABLE 1

| Fuel Composition | Lubricity additive composition | | | Sulphur in | | |
|---|---|---|---|---|---|---|
| | 2-ethylhexanoic acid (weight %) | Ethylene glycol (weight %) | Monoethanolamine (weight %) | diesel (ppm | DLA ppm | WSD (μM) |
| 1 | — | — | — | 5 | — | 580 |
| 2 | 100 | — | — | 5 | 50 | 482 |
| 3 | 100 | — | — | 5 | 90 | 430 |
| 4 | — | 100 | — | 5 | 50 | 562 |
| 5 | — | — | 100 | 5 | 50 | 560 |
| 6 | — | 50 | 50 | 5 | 50 | 608 |
| 7 | 80 | 10 | 10 | 5 | 50 | 453 |
| 8 | 80 | 10 | 10 | 5 | 90 | 428 |
| 9 | — | — | — | 10 | — | 548 |
| 10 | 100 | — | — | 10 | 50 | 427 |
| 11 | 100 | — | — | 10 | 75 | 393 |
| 12 | 80 | 10 | 10 | 10 | 50 | 412 |
| 13 | 80 | 10 | 10 | 10 | 75 | 375 |

Table 1 above depicts the WSD values for different fuel compositions that were tested. The control formulations, viz. 1 and 9 with sulphur content of 5 and 10 ppm, demonstrated WSD values of 580 μM and 548 μM respectively, which is higher than the acceptable value, i.e. 460 μM. For composition number. 4, 5 and 6, wherein ethylene glycol and monoethanolamine were tested individually and in combination, there was no improvement in the lubricity of the fuel. Additionally, 2-ethyl hexanoic acid when tested individually with different concentrations of sulphur, was only able to reduce the WSD of the fuel marginally (composition no. 2, 3, 10 and 11).

Surprisingly, when the three components were added together in the ratio of 1:0.125:0.125 of 2-ethanoic acid to ethylene glycol to monoethanolamine (fuel composition: 7, 8, 12 and 13) a substantial decrease in the WSD values, viz. 453 μM, 428 μM, 412 μM and 375 μM was observed. The lower WSD indicates an enhancement in the lubricity of the fuel. Further, an increase in the total DLA content lead to further enhancement in the lubricity (composition no. 13).

Therefore, from the data displayed in the table above, it can be inferred that a combination of 2-ethylhexanoic acid, ethylene glycol and monoethanolamine synergistically increase the lubricative property of the diesel fuel with low sulphur content which is reflected in the decrease in the wear scar diameter. The synergism of the components in the composition is apparent, as individually the components were not able to enhance the lubricity.

Advantages of the Present Disclosure

Overall, the present disclosure provides a formulation comprising 2-ethylhexanoic acid, at least one alkylene glycol and at least one alkanolamine, which at specific ratio of 1:0.125:0.125, was able to enhance the lubricity of ultra-low-sulphur diesel. This was confirmed from the observations obtained in wear scar diameter determination experiments. The formulation can further be utilized to improve the lubricity of the fuel with low sulphur content and thereby reduce the incidences of wear and engine failures.

We claim:

1. A method for enhancing lubricity of a fuel, the method comprising, contacting the lubricity additive formulation comprising:

(a) 2-ethylhexanoic acid;

(b) at least one alkylene glycol; and (c) at least one alkanolamine with a fuel to obtain a fuel composition with enhanced lubricity.

2. The method as claimed in claim 1, wherein the lubricity additive formulation has concentration in the range of 20-120 ppm in the fuel composition.

3. The method as claimed in claim 1, wherein the fuel is a diesel having sulphur content in the range of 5-50 ppm.

4. A fuel composition comprising: (a) fuel; and (b) lubricity additive formulation comprising:

(a) 2-ethylhexanoic acid;

(b) at least one alkylene glycol; and (c) at least one alkanolamine.

5. The fuel composition as claimed in claim 4, wherein the fuel is a diesel having sulphur content in the range of 5-50 ppm.

6. A method for preparation of a fuel composition as claimed in claim 4, the method comprising steps of:

(a) obtaining lubricity additive formulation comprising: (i) 2-ethylhexanoic acid; (ii) at least one alkylene glycol; and (iii) at least one alkanolamine;

(b) obtaining a fuel; and (c) contacting the lubricity additive formulation and the fuel to obtain the fuel composition.

7. The method as claimed in claim 6, wherein the fuel is a diesel having sulphur content in the range of 5-50 ppm.

8. The method of claim 6 wherein the step of: (a) obtaining the lubricity additive formulation comprising: (i) 2-ethylhexanoic acid: (ii) at least one alkylene glycol; and (iii) at least one alkanolamine;

comprises the steps of:—(a) contacting 2-ethylhexanoic acid, and the at least one alkanolamine to obtain mixture-1 is carried out a temperature in the range of 25-35° C. for a period in the range of 5-15 minutes at a stirring speed in the range of 200-500 rpm; —and—

(b) contacting the mixture-1 and the at least one alkylene glycol to obtain lubricity additive formulation is carried out a temperature in the range of 25-35° C. for a period in the range of 50-80 minutes at a stirring speed in the range of 200-500 rpm.

* * * * *